US010337718B2

(12) United States Patent
Chen et al.

(10) Patent No.: US 10,337,718 B2
(45) Date of Patent: Jul. 2, 2019

(54) LIGHT EMITTING DIODE LIGHTING DEVICE AND ASSEMBLY METHOD THEREOF

(71) Applicant: HANGZHOU HPWINNER OPTO CORPORATION, Hangzhou (CN)

(72) Inventors: Kai Chen, Hangzhou (CN); Jianming Huang, Hangzhou (CN)

(73) Assignee: HANGZHOU HPWINNER OPTO CORPORATION, Hangzhou (CN)

( * ) Notice: Subject to any disclaimer, the term of this patent is extended or adjusted under 35 U.S.C. 154(b) by 0 days.

(21) Appl. No.: 15/557,072

(22) PCT Filed: Mar. 11, 2016

(86) PCT No.: PCT/CN2016/076127
§ 371 (c)(1),
(2) Date: Sep. 8, 2017

(87) PCT Pub. No.: WO2016/146025
PCT Pub. Date: Sep. 22, 2016

(65) Prior Publication Data

US 2018/0066815 A1 Mar. 8, 2018

(30) Foreign Application Priority Data

Mar. 13, 2015 (CN) ..... 2015 1 0110569

(51) Int. Cl.
*F21V 5/00* (2018.01)
*F21V 17/16* (2006.01)
(Continued)

(52) U.S. Cl.
CPC ..... *F21V 31/005* (2013.01); *F21V 5/007* (2013.01); *F21V 17/164* (2013.01); *F21K 9/237* (2016.08);
(Continued)

(58) Field of Classification Search
CPC ..... F21V 19/0035; F21V 31/005; F21V 5/007
See application file for complete search history.

(56) References Cited

U.S. PATENT DOCUMENTS 6,435,691 B1 * 8/2002 Macey ..... F21S 8/024 362/101
7,182,627 B1 * 2/2007 Huang ..... F21K 9/00 439/487
(Continued)

FOREIGN PATENT DOCUMENTS

CN 101174612 A 5/2008
CN 201973590 U 9/2011
(Continued)

OTHER PUBLICATIONS

International Preliminary Report on Patentability dated Sep. 19, 2017 for PCT Application No. PCT/CN2016/076127.
(Continued)

*Primary Examiner* — Alexander K Garlen
(74) *Attorney, Agent, or Firm* — Plumsea Law Group, LLC

(57) ABSTRACT

A light emitting diode (LED) lighting device and assembly method thereof. The LED lighting device includes: a base having a mounting surface; an LED element disposed on the mounting surface of the base; a lens component disposed at a side of the mounting surface of the base; a gasket disposed between the base and the lens component, such that the LED element is located within an area surrounded by the gasket; a fastener comprising a first portion and a second portion, wherein the first component is disposed at the side of the lens component opposite to the base and facing a portion of the lens component, the second portion extends from the first portion and is connected to the base, and the first portion of the fastener applies a pressure on the lens component towards the base.

21 Claims, 4 Drawing Sheets

(51) Int. Cl.

| | |
|---|---|
| ***F21V 19/00*** | (2006.01) |
| ***F21V 31/00*** | (2006.01) |
| ***F21Y 105/10*** | (2016.01) |
| ***F21Y 115/10*** | (2016.01) |
| *F21K 9/237* | (2016.01) |
| *F21S 2/00* | (2016.01) |

(52) U.S. Cl.
CPC ..... *F21S 2/005* (2013.01); *F21V 19/0035* (2013.01); *F21Y 2105/10* (2016.08); *F21Y 2115/10* (2016.08)

(56) References Cited

U.S. PATENT DOCUMENTS

| | | | | |
|---|---|---|---|---|
| 7,976,194 | B2 * | 7/2011 | Wilcox | F21V 5/007 362/267 |
| 8,899,786 | B1 * | 12/2014 | Moghal | F21V 31/005 362/244 |
| 2009/0298376 | A1 * | 12/2009 | Guillien | F21V 5/04 445/43 |
| 2010/0315823 | A1 * | 12/2010 | Lin | F21V 19/0035 362/368 |
| 2011/0305020 | A1 * | 12/2011 | Wang | F21K 9/00 362/249.02 |
| 2012/0188766 | A1 * | 7/2012 | Lu | F21V 29/004 362/249.02 |
| 2013/0121759 | A1 * | 5/2013 | Breidenassel | F21V 7/00 403/330 |
| 2014/0168975 | A1 | 6/2014 | Keat et al. | |
| 2014/0177226 | A1 | 6/2014 | Goelz et al. | |
| 2014/0313732 | A1 | 10/2014 | Seok et al. | |
| 2016/0209023 | A1 * | 7/2016 | Tseng | F21V 31/005 |
| 2017/0038056 | A1 * | 2/2017 | Joiris | F21V 19/003 |

FOREIGN PATENT DOCUMENTS

| | | | | |
|---|---|---|---|---|
| CN | 202120907 | U | 1/2012 | |
| CN | 102364685 | A | 2/2012 | |
| CN | 202521321 | U | 11/2012 | |
| CN | 103915558 | A | 7/2014 | |
| CN | 105042356 | A | 11/2015 | |
| DE | 10321992 | A1 | 3/2005 | |
| EP | 2765351 | A1 * | 8/2014 | F21V 21/047 |
| JP | 5926808 | U | 2/1984 | |
| JP | 2008156217 | A | 7/2008 | |
| JP | 2011100734 | A | 5/2011 | |
| JP | 2014072106 | A | 4/2014 | |
| JP | 2014137856 | A | 7/2014 | |

OTHER PUBLICATIONS

International Search Report and Written Opinion dated Jun. 13, 2016 for PCT Application No. PCT/CN2016/076127.
Extended European Search Report dated Jul. 7, 2018 in European Patent Application No. 16764205.
Office Action dated Jun. 12, 2018 in Japanese Patent Application No. 2017-546762 (machine translation).

* cited by examiner

LIGHT EMITTING DIODE LIGHTING DEVICE AND ASSEMBLY METHOD THEREOF

TECHNICAL FIELD

The present invention relates to a light emitting diode (LED) lighting device and an assembly method thereof.

BACKGROUND

Light emitting diode (LED) lighting device has good application prospect due to the advantages of energy saving, long service life, good applicability, short response time, environmental protection, etc.

As the performances of LEDs can be easily affected by humidity, temperature and mechanical vibration, in order to allow the LEDs to operate normally within the service life, the LED lighting device is required to have good water resistance, heat dispersion and mechanical vibration resistance.

SUMMARY

An embodiment of the disclosure provides a light emitting diode (LED) lighting device, comprising: a base having a mounting surface; a LED element disposed on the mounting surface of the base; a lens component disposed on a side of the mounting surface of the base; a gasket disposed between the base and the lens component, so that the LED element can be disposed in an area encircled by the gasket; and a fixing element, including a first part which is disposed on a side of the lens component opposite to the base and faces a part of the lens component, and a second part extended from the first part and connected with the base, and the first part of the fixing element being configured to apply a pressure towards the base to the lens component.

For example, in the LED lighting device provided by an embodiment of the disclosure, taking the gasket as a fulcrum, an absolute value of a force moment applied to the lens component by the first part of the fixing element on an inner side of the gasket is greater than or equal to an absolute value of a force moment applied to the lens component by the first part of the fixing element on an outer side of the gasket.

For example, in the LED lighting device provided by an embodiment of the disclosure, a closed accommodating space is formed in an area encircled by the gasket and between the lens component and the base; and the LED element is disposed in the accommodating space.

For example, in the LED lighting device provided by an embodiment of the disclosure, the first part of the fixing element is an annular structure and set to be partially overlapped with a periphery of the lens component in a direction perpendicular to the mounting surface of the base.

For example, in the LED lighting device provided by an embodiment of the disclosure, in a mutually facing area of the first part of the fixing element and the lens component, a protrusion is formed on one of a surface of the first part of the fixing element facing the lens component and a surface of the lens component facing the fixing element, and a first recess is formed on the other one; and the protrusion is embedded into the first recess.

For example, in the LED lighting device provided by an embodiment of the disclosure, there is a gap between the first part of the fixing element and the lens component, and between the protrusion or the first recess and the second part of the fixing element.

For example, in the LED lighting device provided by an embodiment of the disclosure, the protrusion or the first recess is disposed on the inner side of the gasket or directly above the gasket.

For example, in the LED lighting device provided by an embodiment of the disclosure, the protrusion is disposed on the first part of the fixing element, and the first recess is disposed in the lens component.

For example, in the LED lighting device provided by an embodiment of the disclosure, the second part is extended from a side surface of the lens component to a side surface of the base.

For example, in the LED lighting device provided by an embodiment of the disclosure, a mutually matched clamping structure is formed by the second part of the fixing element and the base, so as to connect the second part to the base.

For example, in the LED lighting device provided by an embodiment of the disclosure, a mutually matched threaded structure is formed by an inner side of the second part of the fixing element facing the base and a side surface of the base facing the second part, so as to connect the second part to the base.

For example, in the LED lighting device provided by an embodiment of the disclosure, the second part of the fixing element is connected to the base through a fastener.

For example, in the LED lighting device provided by an embodiment of the disclosure, a second recess is formed in at least one of mutually facing surfaces of the lens component and the base; and the gasket is disposed in the second recess.

For example, in the LED lighting device provided by an embodiment of the disclosure, a distance between a surface of a position of the lens component contacting with the gasket and a surface of a position of the base contacting with the gasket is less than an original size of the gasket when not pressurized in the direction perpendicular to the mounting surface of the base.

For example, in the LED lighting device provided by an embodiment of the disclosure, sealant is disposed at the gasket between the base and the lens component.

For example, in the LED lighting device provided by an embodiment of the disclosure, the sealant is disposed on the outer side of the gasket.

For example, in the LED lighting device provided by an embodiment of the disclosure, the LED element includes at least one LED element; the lens component includes at least one lens; and the at least one LED element and the at least one lens are in one-to-one correspondence.

For example, in the LED lighting device provided by an embodiment of the disclosure, at least one part of the lens component makes contact with the base in the area encircled by the gasket.

For example, in the LED lighting device provided by an embodiment of the disclosure, the lens component is a transparent plate member provided with the lens.

For example, in the LED lighting device provided by an embodiment of the disclosure, the second part is an integral annular structure.

For example, in the LED lighting device provided by an embodiment of the disclosure, the second part includes a plurality of separate second subparts.

For example, in the LED lighting device provided by an embodiment of the disclosure, the plurality of second subparts is uniformly distributed at the periphery of the lens component.

For example, in the LED lighting device provided by an embodiment of the disclosure, the LED lighting device is an LED module or an LED lamp.

An embodiment of the disclosure further provides an assembly method of the LED lighting device, comprising: setting a surface of the first part of the fixing element facing the lens component to be upwards, and disposing the lens component on the fixing element; disposing the gasket on the lens component; and disposing the base provided with the LED element on the lens component and the gasket in a state that a side provided with the LED element faces the lens component, and connecting the second part of the fixing element to the base.

For example, in the assembly method of the LED lighting device provided by an embodiment of the disclosure, in a mutually facing area of the first part of the fixing element and the lens component, a protrusion is formed on one of a surface of the first part of the fixing element facing the lens component and a surface of the lens component facing the first part of the fixing element, and a first recess is formed in the other one; and during disposing the lens component on the fixing element, the protrusion is embedded into the first recess.

For example, in the assembly method of the LED lighting device provided by an embodiment of the disclosure, before disposing the base on the lens component and the gasket, further comprising: disposing sealant at the gasket on the lens component.

For example, in the assembly method of the LED lighting device provided by an embodiment of the disclosure, the sealant is disposed on the outer side of the gasket.

For example, in the assembly method of the LED lighting device provided by an embodiment of the disclosure, a second recess matched with the gasket is formed in the lens component; and the lens is disposed in the second recess.

BRIEF DESCRIPTION OF THE DRAWINGS

In order to clearly illustrate the technical solution of the embodiments of the invention, the drawings of the embodiments will be briefly described in the following; it is obvious that the described drawings are only related to some embodiments of the invention and thus are not limitative of the invention.

DETAILED DESCRIPTION

In order to make objects, technical details and advantages of the embodiments of the invention apparent, the technical solutions of the embodiment will be described in a clearly and fully understandable way in connection with the drawings related to the embodiments of the invention. It is obvious that the described embodiments are just a part but not all of the embodiments of the invention. Based on the described embodiments herein, those skilled in the art can obtain other embodiment(s), without any inventive work, which should be within the scope of the invention.

Unless otherwise specified, the technical terms or scientific terms used herein shall have normal meanings understood by those skilled in the art. The words "first", "second" and the like used in the description and the claims of the patent application of the present invention do not indicate the sequence, the number or the importance but are only used for distinguishing different components.

Figure 1:
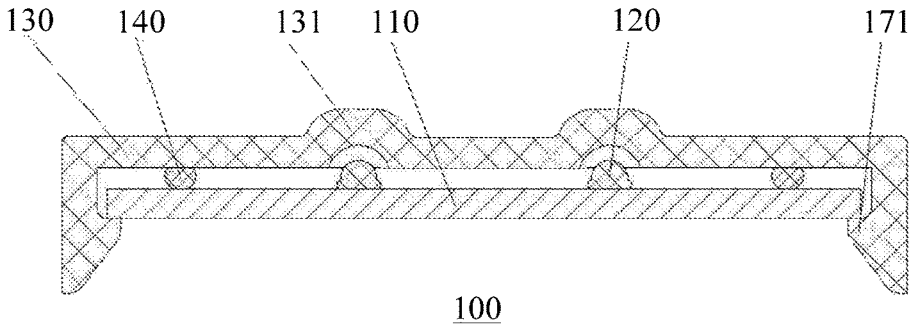
FIG. 1 is a schematic sectional view of an LED lighting device.

An LED lighting device 100 is provided. As illustrated in FIG. 1, the LED lighting device 100 comprises at least one LED element 120; a base 110 for mounting the LED element 120; a lens component 130 disposed above the LED element 120, in which at least one lens 131 is disposed on the lens component 130, and each tens 131 corresponds to one LED element 120 and is used for providing light distribution for the LED element 120 corresponding to the lens; and a gasket 140 which is pressed between the lens component 130 and the base 110 and used for sealing. The LED element 120 is disposed in a closed space formed by the lens component 130, the base 110 and the gaskets 140. The gasket 140 is pressed between the lens component 130 and the base 110, subjected to elastic deformation, and tightly attached to surfaces of the lens component 130 and the base 110. The lens component 130 is fixed on the base 110 through a clamping structure 171.

In the above structure, the lens component 130 and the clamping structure 171 are integrally formed. The light transmittance, the mechanical performance and the outdoor performance of materials must be considered during the selection of the materials of the lens component 130. The clamping structure will be usually deformed and requires good hardness, strength and elasticity. Therefore, if the lens component 130 and the clamping structure 171 are integrally formed, the materials for manufacturing the lens component and the clamping structure have less variety. In addition, as the clamping structure 171 and the lens component 130 are integrally formed, different products need multiple integrally formed molds of the clamping structure and the lens component, so the cost of the integrally formed molds is high, and the mold-repair cost is also high. Moreover, in order to ensure the sealability, the gasket 140 is pressed, and a middle part of the lens component 130 can be easily protruded towards the direction away from the LED element 120 under the action of the clamping structure 171 and the gasket 140. The lens 131 in the lens component 130 is mainly used for providing light distribution for the LED element 120. The deformation of the lens component 130 will directly affect the accuracy of light distribution, and hence affect the performances of the LED lighting device 100.

The embodiment of the present invention provides an LED lighting device, which comprises: a base having a mounting surface; LED elements disposed on the mounting surface of the base; a lens component disposed on a side of the mounting surface of the base; a gasket disposed between the base and the lens component, so that the LED elements can be disposed in an area encircled by the gasket; and a fixing element, including a first part which is disposed on a side of the lens component opposite to the base and faces a part of the lens component, and a second part extended from the first part and connected with the base, and the first part of the fixing element is configured to apply a pressure towards the base to the lens component. In the embodiment of the present invention, the fixing element and the lens component are separate components; the fixing elements are only required to have good elasticity and high strength; and the requirements of elasticity and strength on the lens component are reduced. Thus, the range of optional materials for manufacturing the lens component is increased. In addition, as the fixing element and the lens component are separate components, the fixing element and the lens component may be respectively formed; only one set of mold of the fixing element is required; and molds corresponding to lens components of different products are independently designed and manufactured. Thus, the molds for manufacturing the fixing element and the lens component are simplified, and the cost of manufacturing and repairing the molds is reduced.

In some embodiments of the present invention, taking the gasket as a fulcrum, the absolute value of the force moment applied to the lens component by the first part of the fixing element on the inner side of the gasket is greater than or equal to the absolute value of the force moment applied to the lens component by the first part of the fixing element on the outer side of the gasket.

The LED lighting device and the assembly method thereof, provided by at least one embodiment of the present invention, can avoid the problem that the middle part of the lens component is easily protruded.

First Embodiment

Figure 2A:
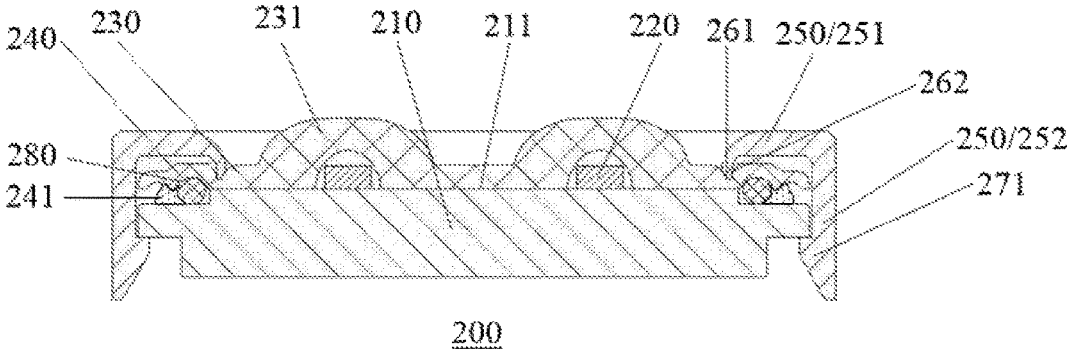
FIG. 2*a* is a schematic sectional view of an LED lighting device.
Figure 2B:
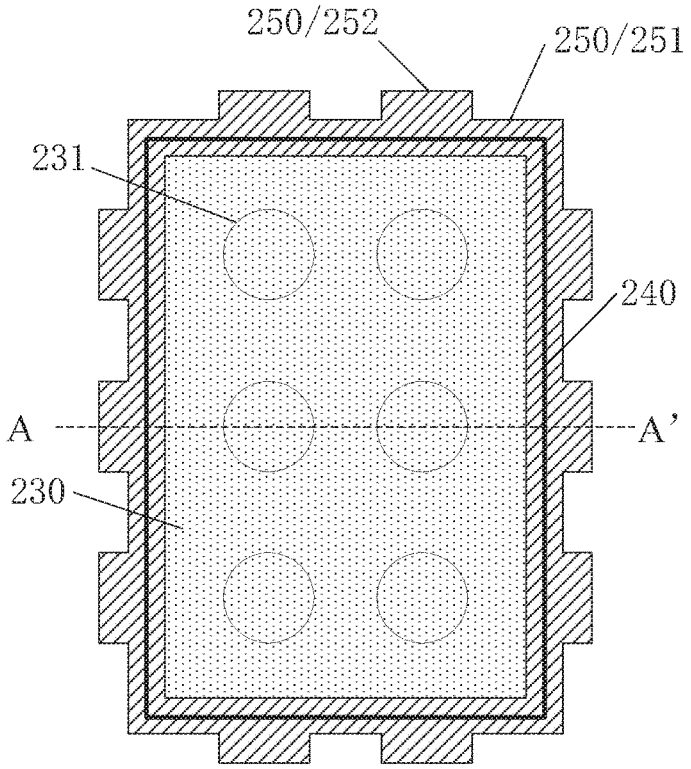
FIG. 2*b* is a schematic plan view of the LED lighting device.

FIGS. 2*a* and 2*b* are schematic diagram of an LED lighting device provided by one embodiment of the present invention; FIG. 2*b* is a plan view; and FIG. 2*a* is a sectional view sectioned along an AA' line in FIG. 2*b*. As illustrated in FIGS. 2*a* and 2*b*, the LED lighting device 200 comprises: a base 210 having a mounting surface 211; an LED element 220 disposed on the mounting surface 211 of the base 210; a lens component 230 disposed on a side of the mounting surface 211 of the base 210; a gasket 240 disposed between the base 210 and the lens component 230, so that the LED element 220 can be disposed in an area encircled by the gasket 240; and a fixing element 250, including a first part 251 which is disposed on a side of the lens component 230 opposite to the base 210 and face a part of the lens component 230, and a second part 252 extended from the first part 251 and connected with the base 210, and the first part 251 of the fixing element 250 being configured to apply a pressure towards the base 210 to the lens component 230.

For example, taking the gasket 240 as a fulcrum, the absolute value of the force moment applied to the lens component 230 by the first part 251 of the fixing element 250 on the inner side of the gasket 240 is greater than or equal to the absolute value of the force component applied to the lens component 230 by the first part 251 of the fixing element 250 on the outer side of the gasket 240.

As illustrated in FIGS. 2*a* and 2*b*, the fixing element 250 presses the lens component 230 onto the base 210; and in virtue of the sealability of the gasket, the area encircled by the gasket 240, between the lens component 230 and the base 210, forms a closed accommodating space. That is to say, the accommodating space is encircled by the lens component, the base and the gasket. The LED element 220 is disposed in the accommodating space. In the embodiment of the present invention, the fixing element 250 is divided into the first part 251 and the second part 252, and such a division is just for the sake of simple description. The first part 251 and the second part 252 of the fixing element 250 may be fixedly connected and may also be integrally formed. No special limitation will be given here in the embodiment of the present invention. As the first part 251 is a part facing a side of the lens component 230 opposite to the base, the first part 251 is a part directly applying the pressure to the lens component 230.

In the structure as illustrated in FIG. 1, as the lens component and parts fixed to the base are an integral structure, in the fixing process, the gaskets 140 will form fulcrums, so as to form protrusions in the middle part of the lens component (the part on the inner side of the gasket), and hence affect the light distribution between the LED element and lens corresponding to the LED element. In the embodiment of the present invention, the lens component 230 and the fixing element 250 are mutually separate structures. The lens component 230 and the gasket 240 are considered as a lever; the first part 251 of the fixing element 250 applies a pressure towards the base 210 to the lens component 230; and taking the gasket 240 as the fulcrum, the absolute value of the force moment applied to the lens component 230 by the first part 251 of the fixing element 250 on the inner side of the gasket 240 is greater than the absolute value of the force moment applied to the lens component 230 by the first part 251 of the fixing element 250 on the outer side of the gasket 240. When the force moment is set like this, the part of the lens component 230 disposed on the inner side of the gasket tends to be pressed towards the base. Thus, the embodiment prevents the middle part of the lens component 230 from being protruded towards the direction away from the LED element 220, avoids the change of the relative position of the lens component 230 and the LED element 220, and ensures good light distribution performance of the lens component 230 and the LED element 220.

The description that the absolute value of the force moment applied to the lens component 230 by the first part 251 of the fixing element 250 on the inner side of the gasket 240 is greater than the absolute value of the force moment applied to the lens component 230 by the first part 251 of the fixing element 250 on the outer side of the gasket 240 may be that: the first part 251 only makes contact with the lens component 230 on the inner side of the gasket or directly above the gasket, namely a downward pressing force is only applied to the lens component 230 on the inner side of the gasket (at this point, it can be seen that the force moment applied by the first part 251 on the outer side of the gasket is 0); and may also be that: the first part 251 makes contact with the lens component 230 on both the outer side and the inner side of the gasket, but the applied force moment satisfies the above relationship. No special limitation will be given here in the embodiment of the present invention. From another point of view, if the forces applied by the first part 251 to the lens component 230 are combined into one three, the action point of the resulting force is disposed on the inner side of the gasket or directly above the gasket, so as to ensure that the middle part of the lens component 230 cannot be protruded upwards by the pressing of the fixing elements 250.

Figure 3:
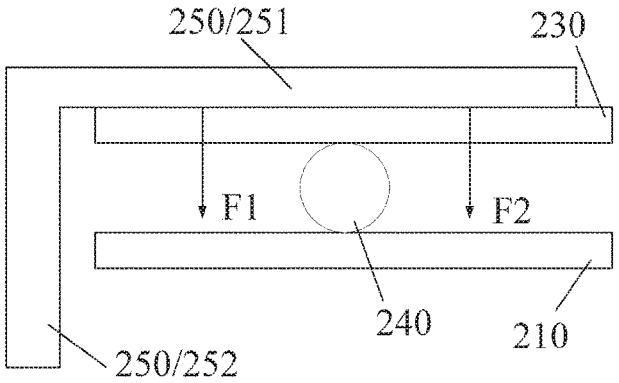
FIG. 3 is a schematic sectional partial view of an LED lighting device.

FIG. 3 is a schematic sectional partial view sectioned in the extension direction perpendicular to the gasket and only illustrates partial section near the gasket. As can be seen from FIG. 3, the first part can only apply a downward pressure (towards the direction of the base) to the lens component on the outer side and the inner side of the gasket. The pressure of the first part 251 of the fixing element 250 on the lens component 230 may include a force F1 on the outer side of the gasket 240 and a force F2 on the inner side of the gasket. By taking the gasket 240 as a fulcrum, the force F1 and the force F2 form two force moments. The two force moments allow the lens component 230 to have different rotation tendencies around the gasket 240. If the absolute value of the force moment formed by the force F1 is greater than the absolute value of the force moment formed by the force F2, a part of the lens component 230 on the outer side of the gasket is pressed down, and the middle part of the lens component 230 is protruded upwards. If the absolute value of the force moment formed by the force F2 is greater than or equal to the absolute value of the force moment formed by the force F1, the middle part of the lens component 230 will not be protruded, so as to ensure the matching relationship between the lens in the lens component and the LED element. Description is given in FIG. 3 only by taking two simple threes F1 and F2 as an example, and F1 and F2 may be respectively a plurality of forces dispersedly applied to the outer side and the inner side of the gasket. In some embodiments, F1 may also be 0. At this point, it may be considered that partial force moment applied by the first part 251 to the outer side of the lens component 230 is 0.

In some embodiments of the present invention, the above force moment relationship between the fixing element 250 and the lens component 230 is satisfied at each section perpendicular to the gasket 240, so as to further ensure that the middle part of the lens component 230 cannot be protruded upwards.

In the description, "disposed directly above the gasket" refers to being overlapped with the position of the gasket in the direction perpendicular to the mounting surface of the base and being disposed on a side of the lens component 230 opposite to the base. In the description, the inner side and the outer side of the gasket are directions in parallel to a plane of the mounting surface of the base 210; an area encircled by the gasket may be referred to as the inner side of the gasket; and an area on the outside of the gasket may be referred to as the outer side of the gasket.

For example, the LED element 220, for example, is an individually packaged LED lamp bead, an integrated LED source or an LED chip.

For example, the base 210 is a lamp housing or a radiator, and the mounting surface 211 of the base 210 is used for mounting the LED element 220. The LED element 220 may be directly disposed on the base 210. The LED elements may also be disposed on a printed circuit board (PCB) to form a printed circuit board assembly (PCBA) provided with the LED element, and then the PCBA is disposed on the base 210. No specific limitation is given to the base 210 in the embodiment of the present invention. For example, the base may be a hard substrate, on which the LED element 220 is directly disposed; and may also be a superimposed structure including a PCB and a radiator structure.

For example, the lens component 230 may be provided with a strengthening rib or partially thickened to prevent the lens component 230 for being deformed. The material of the lens component 230 is, for example, polycarbonate (PC) or polymethyl methacrylate (PMMA).

For example, the fixing element 250, for example, may be a gland, a radiator or a lamp housing. The fixing element 250, for example, may be made from transparent materials or metallic materials having the advantages of easy production, low cost and good mechanical performance.

For example, the fixing element 250 and the lens component 230 are separate components. If the fixing element 250 and the lens component 230 are integrally formed, elastic deformation is needed when the fixing element and the lens component are clamped with the base 210, so the good elasticity and high strength are required. Thus, the materials for manufacturing the fixing element 250 and the lens component 230 have less variety. If the fixing element 250 and the lens component 230 are separate components, only the fixing element 250 is required to have good elasticity and high strength, and the requirements on the elasticity and the strength of the lens component 230 are reduced. Therefore, the range of optional materials for manufacturing the lens component 230 is increased, so different materials may be adopted to manufacture the lens component 230 according to different performance requirements. For example, when the flame retardancy requirement is high, glass or the like having high flame retardancy but poor elasticity may be adopted. For example, when the strength requirement is high, organic glass materials or inorganic glass materials with high strength but poor elasticity may be adopted. For example, when the light transmittance requirement is high, PMMA materials with high transmittance but poor strength may be adopted.

For example, if the fixing element 250 and the lens component 230 are integrally formed, different products require multiple integrally formed molds of the fixing element 250 and the lens component 230; the cost of the integrally formed molds of the fixing element 250 and the lens component 230 is high; and the mold-repair cost is also high. If the fixing element 250 and the lens component 230 are separate components, the fixing element 250 and the lens component 230 are respectively formed; only one set of mold of the fixing element 250 is required; and molds corresponding to lens components 230 of different products are individually designed and manufactured. Thus, the molds for manufacturing the fixing element 250 and the lens component 230 are simplified, and the cost of manufacturing and repairing the molds is reduced.

For example, the gasket 240 is, for example, a closed ring; the sectional shape of the gasket is, for example, circular, T-shaped, 7-shaped, etc.; and the material of the gasket 240 is, for example, silica gel, rubber or other elastic materials.

For example, the gasket 240 and the lens component 230 and the base 210 are in interference fit, so that the gasket 240 can be deformed and pressed between the lens component 230 and the base 210. That is to say, the distance between a surface of a position of the lens component 230 contacting with the gasket 240 and a surface of a position of the base 210 contacting the gasket 240 is less than the original size of the gasket 240 when not pressurized in the direction perpendicular to the mounting surface 211 of the base 210. That is to say, the gasket 240 is pressed between the lens component 230 and the base 210, subjected to elastic deformation, and tightly attached to surfaces of the lens component 230 and the base 210. The interference fit is favorable for the forming of the sealed accommodating space.

For example, in the LED lighting device 200 provided by one embodiment of the present invention, the first part 251 of the fixing element 250 is an annular structure and set to be partially opposite to the periphery of the lens component 230, namely the first part 251 of the fixing element 250 is set to be partially overlapped with the periphery of the lens component in the direction perpendicular to the mounting surface of the base. The structure is favorable for achieving uniform force of the lens component 230 and ensuring good sealability of the accommodating space.

For example, in the LED lighting device 200 provided by one embodiment of the present invention, in a mutually facing area of the first part 251 of the fixing element 250 and the lens component 230, a protrusion 251 is formed on one of a surface of the first part 251 of the fixing element 250 facing the lens component 230 and a surface of the lens component 230 facing the first part 251 of the fixing element 250, and a first recess 262 is formed on the other one; and the protrusion 261 is embedded into the first recess 262. For example, in the embodiment as illustrated in FIG. 2*a*, a protrusion 261 facing the lens component is formed on the fixing element 250, and a recess 262 matched with the protrusion 261 is formed on the lens component 230. The protrusion 261 is embedded into the recess 262.

For example, the protrusion 261 and the first recess 262 are disposed on the inner side of the gasket 240 or directly above the gasket 240. In the embodiment provided with the protrusion 261 and the first recess 262, due to the setting of the protrusion 261 and the first recess 262, the mutual positional relationship between the fixing element 250 and the lens component 230 can be stable.

For example, the protrusion 261 may be an annular structure; or a plurality of protrusions 261 is provided, and the protrusions 261 are spaced from each other and arranged along the extension direction of the annular structure of the fixing element; and the first recess 262 is an annular recess matched with the protrusion 261, or is a plurality of recesses arranged at intervals and corresponding to the plurality of protrusions 261. For example, the protrusion 261 having the annular structure and the annular recess 262 provide convenience for assembly.

For example, in the LED lighting device 200 provided by one embodiment of the present invention, as illustrated in FIG. 2*a*, there is a gap between the first part 251 of the fixing element 250 and the lens component 230, and between the protrusion 261 or the first recess 262 and the second part 252 of the fixing element 250. As described above, by reasonable setting of the height of the protrusion and the depth of the first recess, the position of the protrusion 261 and the first recess 262 may become the force application point between the fixing element 250 and the lens component 230. There is a gap between the first part 251 of the fixing element 250 and the lens component 230, so this part of the fixing element 250 will not apply force to the lens component 230. Thus, the setting can more easily control the state of the three applied to the lens component 230, can more easily realize the above force moment relationship, and hence avoid the protrusion of the lens component on the inner side of the gasket. Thus, the protrusion of the lens component 230 towards the direction away from the LED element 220 can be avoided, and good light distribution performance of the lens component 230 on the LED element 220 can be guaranteed.

For example, in the LED lighting device 200 provided by one embodiment of the present invention, the protrusion 261 is disposed on the first part 251 of the fixing element 250, and the first recess 262 is disposed in the lens component.

For example, the first recess 262 may also be disposed in the first part 251 of the fixing element 250, and the protrusion 261 is disposed on the lens component 230.

For example, the protrusion 261 is, for example, a stepped protrusion, and the first recess 262 is, for example, a stepped recess engaged with the stepped protrusion.

For example, in the LED lighting device 200 provided by one embodiment of the present invention, as illustrated in FIG. 2, the second part 252 is extended from a side surface of the lens component 230 to a side surface of the base 210.

For example, in the LED lighting device 200 provided by one embodiment of the present invention, a mutually matched clamping structure 271 is formed by the second part 252 of the fixing element 250 and the base 210, so as to connect the second part 252 to the base 210. No special limitation is given to the specific form of the clamping structure 271 in the embodiment of the present invention. For example, as illustrated in FIG. 2, a projection projected towards the inner side is formed at the tail end of the second part 252. The projection may be clamped with a concave structure on the base. The embodiment of the present invention may also adopt any other suitable clamping structure.

For example, the second part 251 of the fixing element 250 may be adjusted, so that parts of the second part 251 distributed at the periphery of the lighting device can have consistent size, and hence uniform acting force can be applied to the lens component by the parts of the fixing element 250. In addition, the clamping structure 271 can avoid tiny gaps formed between the gasket 240 and the lens component 230 and the base 210 due to nonuniform acting force applied to various positions of the gasket 240, and hence avoid water vapor from entering the closed space formed by the lens component 230, the base 210 and the gasket 240 to affect the performances and the service life of the LED element 220.

For example, in the LED lighting device 200 provided by one embodiment of the present invention, a second recess 280 is formed in at least one of mutually facing surfaces of the lens component 230 and the base 210; and the gasket 240 is disposed in the second recess 280.

For example, in the LED lighting device 200 provided by one embodiment of the present invention, sealant 241 is disposed at the gasket 240 between the base 210 and the lens component 230. The double seal of the combination of the sealant 241 and the gasket 240 can further improve the sealability.

For example, in the LED lighting device 200 provided by one embodiment of the present invention, the sealant 241 is disposed on the outer side of the gasket 240. The setting of the sealant 241 on the outer side of the gasket 240 can avoid the sealant 241 from polluting the LED elements 220, and hence can achieve better sealing action.

For example, the second recess 280 matched with the gasket 240 may further improve the sealability, provide convenience for the coating of the sealant, and prevent the sealant from overflowing to pollute the tens component 230 or the LED element 220.

For example, the second recess 280 is, for example, a stepped recess, and the gasket 240 is, for example, a stepped section engaged with the stepped second recess.

For example, in the LED lighting device 200 provided by one embodiment of the present invention, the LED element 220 includes at least one LED element 220; the lens component 230 includes at least one lens 231; and the at least one LED element 220 and the at least one lens 231 are in one-to-one correspondence.

For example, each lens 231 is used for providing tight distribution for corresponding LED element 220.

For example, in the LED lighting device 200 provided by one embodiment of the present invention, at least one part of the lens component 230 makes contact with the base 210 in an area encircled by the gasket 240.

For example, the lens component 230 and the base 210 may adopt surface bonding (for example, most bottom surface of the lens component 230 except the position of the lens is bonded to the base) and may also adopt point bonding. When the lens component and the base adopt surface bonding, the deformation of the lens component 230 may be almost ignored; but during mass production, the manufacturing accuracy requirement is high, so the production cost can be increased. When the lens component and the base adopt point bonding, the lens component 230 tends to be subjected to local deformation; but the manufacturing accuracy requirement is low, so the production cost can be reduced. In actual production, the mode of surface bonding or point bonding may be adopted according to the specific requirements of products, or the mode of combining local surface bonding and point bonding may also be adopted.

For example, in the LED lighting device 200 provided by one embodiment of the present invention, the lens component 230 is a transparent plate member provided with the lens 231.

The integral annular structure of the second part 252 can achieve uniform force on the gasket 240, and hence achieve good sealing effect.

In the embodiment as illustrated in FIG. 2*b*, the second part 252 of the fixing element 250 includes a plurality of separate second subparts. As illustrated in FIG. 2*b*, the second subparts are disposed at the periphery of the lens component 230 or the first part 251. When the second part 252 includes a plurality of second subparts, the weight of products can be reduced, so the materials can be saved, and hence the cost can be reduced.

For example, in the LED lighting device 200 provided by one embodiment of the present invention, the plurality of second subparts is uniformly distributed at the periphery of the lens component 230. The uniform distribution of the plurality of second subparts can achieve uniform force on the gasket 240, and hence achieve good sealing effect.

However, the embodiment of the present invention is not limited to the modes that the fixing element 250 as illustrated in FIG. 2*b* is separated. For example, in the LED lighting device 200 provided by one embodiment of the present invention, the second part 252 of the fixing element 250 may be an integral annular structure. Or the second part 252 of the fixing element 250 may include an annular structure connected with the first part 251 and a plurality of connecting parts extended from the annular structure and connected with the base. The plurality of connecting parts may be uniformly distributed at the periphery of the lens component 230.

No matter the second part of the fixing element 250 includes a plurality of separate opening structures or includes an integral annular structure (clamping structure), when the fixing element 250 and the base 210 are combined, the fixing element and the base may be simultaneously combined at various positions at the periphery of the base. Thus, the fixing element 250 may apply uniform pressure to the periphery of the lens component 230, so as to avoid tiny gaps between the gasket and the lens component and the base due to nonuniform deformation of the gasket caused by nonuniform pressure.

For example, in the LED lighting device 200 provided by one embodiment of the present invention, the LED lighting device is an LED module or an LED lamp. When the LED lighting device is an LED module, the LED lighting device may be mounted into a lamp housing to form an LED lamp.

In the schematic plan view as illustrated in FIG. 2*b*, the lighting device provided by the embodiment of the present invention has a roughly rectangular planar structure. However, the planar shape of the lighting device provided by the embodiment of the present invention is not limited to be rectangular and may be square, circular, elliptical or any other regular or irregular shape.

Second Embodiment

Figure 4:
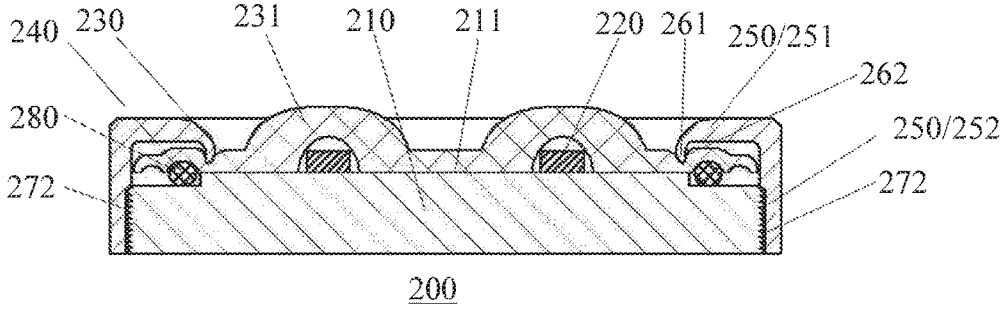
FIG. 4 is a schematic sectional view of an LED lighting device.

One embodiment of the present invention further provides an LED lighting device 200. As illustrated in FIG. 4, a mutually matched threaded structure 272 is formed by an inner side of the second part 252 of the fixing element 250 facing the base 210 and a side surface of the base 210 facing the second part 252, so as to connect the second part 252 to the base 210.

For example, the planar structure of the LED lighting device is a circular structure. The connection between the fixing element 250 and the base 210 adopts threaded connection and is suitable for the assembly of the lighting device with the circular structure.

For example, the threaded structure 272 includes internal threads and external threads. The internal threads are formed on the inner side of the second part of the fixing element facing the base, and the external threads are formed on the side surface of the base facing the second part. The external threads are engaged with the internal threads formed on the inner side of the second part facing the base.

For example, in the mounting process, uniform pressure is applied to the lens component by the fixing element by utilization of the connection mode of the threaded structure 272, so as to avoid tiny gaps formed between the gasket 240 and the lens component 230 and the base 210 caused by nonuniform acting force applied to various positions of the gaskets, and hence avoid water vapor from entering the closed space formed by the lens component 230, the base 210 and the gasket 240 to affect the performances and the service life of the LED element 220. Moreover, the design and production difficulties of the threaded structure 272 is low; the lens component 230 may be directly positioned on the base 210; and the fixing element 250 and the base 210 do not affect the relative position between the lens component 230 and the base 210 during tightening and fixing, so as to ensure good light distribution performance of the lens 231 in the lens component 230 and the LED element 220.

Other structures of the LED lighting device provided by the second embodiment are similar to those in the LED lighting device provided by the first embodiment and may refer to the description in the first embodiment. No further description will be given here.

Third Embodiment

Figure 5:
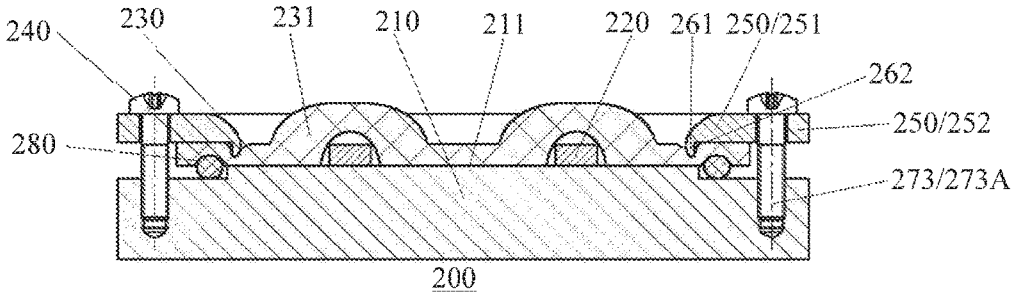
FIG. 5 is a schematic sectional view of an LED lighting device.
Figure 6:
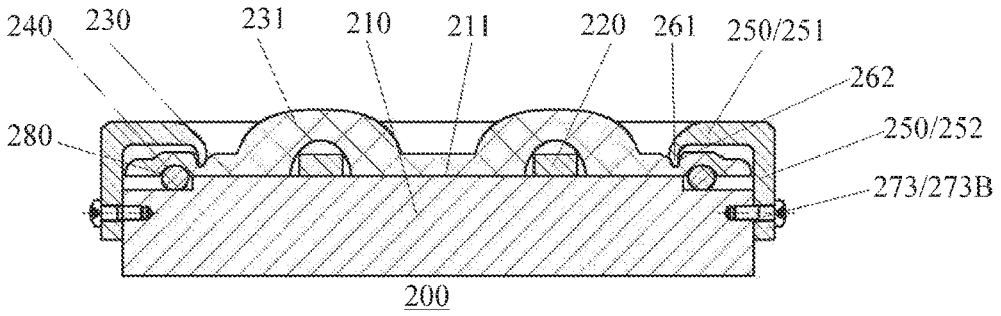
FIG. 6 is a schematic sectional view of an LED lighting device.

For example, one embodiment of the present invention further provides an LED lighting device 200. As illustrated in FIGS. 5 and 6, the second part 252 of the fixing element 250 is connected to the base 210 through a fastener 273.

For example, as illustrated in FIG. 5, a fastener 273A may be disposed in the direction perpendicular to the mounting surface 211 to fix the second part 252 of the fixing element 250 and the base 210.

For example, as illustrated in FIG. 6, a fastener 273B may also be disposed in the direction parallel to the mounting surface 211 (namely at a side surface of the base 210) to fix the second part 252 of the fixing element 250 and the base 210. In the embodiment, the second part of the fixing element 250 includes a portion extended towards the base and extended to the side surface of the base. The portion of the second part extended to the side surface of the base is fixed on the side surface of the base through the fastener 273B.

For example, the fastener 273A and the fastener 273B may be a screw, which may be screwed into a hole with internal threads in the base and fixed. However, the embodiment of the present invention is not limited thereto. The fastener 273A and the fastener 273B may adopt any suitable fastening mode.

For example, a pre-fixing member (not illustrated in the figure) may also be disposed on the second part 252 of the fixing element 250 and the base 210. The pre-fixing member, for example, includes a pin and a pin hole. In some embodiments, the second part 252 of the fixing element 250 is provided with a pin hole for a pin to run through, and the base is also provided with a pin hole for the pin to be inserted and fixed. In the embodiment as illustrated in FIG. 5 in which the fastener 273A is disposed in the direction perpendicular to the mounting surface 211, the pin may also be disposed in the direction perpendicular to the mounting surface 211. In the embodiment as illustrated in FIG. 6 in which the fastener 273B is disposed in parallel to the mounting surface 211, the pin may also be disposed in parallel to the mounting surface 211. That is to say, the setting mode of the pin may refer to the setting mode of the fastener, and but the positions of the pin and the fastener are different in a plane parallel to the mounting surface. The embodiment of the present invention is not limited thereto. During assembly, the lens component 230 and the base 210 are pressed at first, so that the gasket 240 can be deformed; after pressed in place, the pin is inserted into the second part 252 of the fixing element 250 and the base 210, so the positions of the second part of the fixing element and the base can be kept unchanged; and subsequently, the second part 252 of the fixing element 250 and the base 210 are fixed through the fastener 273B. The pin is inserted at first before fixing through the fastener, so that the relative position of the fixing element 250 and the base 210 can be fixed. Thus, the force applied to the lens component 230 by the fixing element 250 is guaranteed to be uniform, and nonuniform pressure caused by respective fixing through different fasteners can be avoided.

For example, when the fastener 273B is fixed on the side surface of the base 210, the influence on the position and the shape of the gasket 240 is small; the force applied to the gasket 240 will not be nonuniform due to different screwed forces of the fastener 273B; and the influence on the sealability of the gasket 240 can be avoided. In addition, the fixing element 273 has simple structure and low cost.

Other structures of the LED lighting device provided by the third embodiment are similar to those of the LED lighting device provided by the first embodiment and may refer to the description in the first embodiment. No further description will be given here.

The first, second and third embodiments respectively enumerate the case that the second part of the fixing element is connected with the base through the clamping structure, the threaded structure or the fastener. But the embodiment of the present invention is not limited thereto, and other connection modes may also be adopted.

Fourth Embodiment

Figure 7:
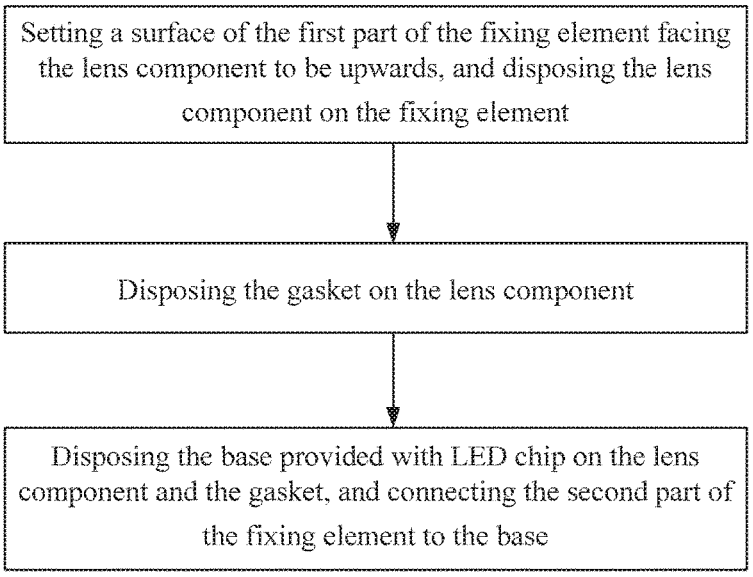
FIG. 7 is a flow diagram of an assembly method of an LED lighting device.

The embodiment of the present invention further provides an assembly method of the LED lighting device. As illustrated in FIG. 7, the assembly method comprises: setting a surface of the first part of the fixing element facing the lens component to be upwards, and disposing the lens component on the fixing element; disposing the gasket on the lens component; and disposing the base provided with the LED element on the lens component and the gasket in a state that a side provided with the LED element faces the lens component, and connecting the second part of the fixing element and the base.

For example, the assembly method of the LED lighting device, provided by one embodiment of the present invention, can avoid the influence on the sealability by the deformation of the gasket under the action of gravity.

For example, the second part of the fixing element and the base are, for example, connected with each other through clamped connection, threaded connection or a fastener. The connection structure may refer to the foregoing embodiment. No further description will be given here. In the connecting process, in the embodiment adopting clamped connection, for example, the integral clamping structure or the plurality of separate clamping structure are simultaneously connected to the base, so that the force applied to the lens component by the fixing element can be uniform. In addition, in the embodiment adopting the connection via the fastener, before the connection between the second part of the fixing element and the base, the pin may also be inserted into the pin holes of the second part of the fixing element and the base after the base is pressed, so that the positions of the fixing element, the lens component and the base can be relatively fixed (pre-fixing step), and subsequently, the fastener is adopted for fixing. For example, a plurality of pins may be uniformly distributed at the periphery of the base and may be simultaneously inserted and fixed.

For example, in the assembly method of the LED lighting device, provided by one embodiment of the present invention, in a mutually facing area of the first part of the fixing element and the lens component, a protrusion is formed on one of a surface of the first part of the fixing element facing the lens component and a surface of the lens component facing the first part of the fixing element, and a first recess is formed on the other one. In the step of disposing the lens component on the fixing elements, the protrusion is embedded into the first recess.

For example, in the assembly method of the LED fighting device, provided by one embodiment of the present invention, before the step of disposing the base on the lens component, and the gasket, the method further comprises: disposing sealant at the gasket on the lens component.

For example, the double seal of the combination of the sealant and the gasket can further improve the sealability.

For example, in the assembly method of the LED lighting device, provided by one embodiment of the present invention, the sealant is disposed on the outer side of the gasket.

For example, the setting of the sealant on the outer side of the gasket can avoid the sealant from polluting the LED element.

For example, in the assembly method of the LED lighting device, provided by one embodiment of the present invention, a second recess matched with the gasket is formed on the lens component; and the gasket is disposed in the second recess.

For example, the setting of the second recess matched with the gasket can further improve the sealability, provide convenience for the coating of the sealant, and prevent the sealant from overflowing to pollute the lens component or the LED element.

The LED lighting device and the assembly method thereof, provided by at least one embodiment of the present invention, can avoid the problem that the middle part of the lens component is easily protruded, and guarantee good light distribution performance of the lens in the lens component and the LED element.

The foregoing is only the preferred embodiments of the present invention and not limited to limit the scope of protection of the present invention. The scope of protection of the present invention shall be defined by the appended claims.

The application claims priority to the Chinese patent application CN201510110569.8, filed Mar. 13, 2015, the disclosure of which is incorporated herein by reference as part of the application.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A light emitting diode (LED) lighting device, comprising:

a base having a mounting surface;

a LED element disposed on the mounting surface of the base;

a lens component disposed on a side of the mounting surface of the base;

a gasket disposed between the base and the lens component, so that the LED element can be disposed in an area encircled by the gasket; and a fixing element, including a first part which is disposed on a side of the lens component opposite to the base and faces a part of the lens component, and a second part extended from the first part and connected with the base, and the first part of the fixing element being configured to apply a pressure towards the base to the lens component, wherein taking the gasket as a fulcrum, an absolute value of a force moment applied to the lens component by the first part of the fixing element on an inner side of the gasket is greater than or equal to an absolute value of a force moment applied to the lens component by the first part of the fixing element on an outer side of the gasket.

2. The LED lighting device according to claim 1, wherein a closed accommodating space is formed in an area encircled by the gasket and between the lens component and the base; and the LED element is disposed in the accommodating space.

3. The LED lighting device according to claim 1, wherein the first part of the fixing element is an annular structure and set to be partially overlapped with a periphery of the lens component in a direction perpendicular to the mounting surface of the base.

4. The LED lighting device according to claim 1, wherein in a mutually facing area of the first part of the fixing element and the lens component, a protrusion is formed on one of a surface of the first part of the fixing element facing the lens component and a surface of the lens component facing the fixing element, and a first recess is formed on the other one; and the protrusion is embedded into the first recess.

5. The LED lighting device according to claim 4, wherein there is a gap between the first part of the fixing element and the lens component, and between the protrusion or the first recess and the second part of the fixing element.

6. The LED lighting device according to claim 5, wherein the protrusion or the first recess is disposed on the inner side of the gasket or directly above the gasket.

7. The LED lighting device according to claim 4, wherein the protrusion is disposed on the first part of the fixing element, and the first recess is disposed in the lens component.

8. The LED lighting device according to claim 1, wherein the second part is extended from a side surface of the lens component to a side surface of the base.

9. The LED lighting device according to claim 1, wherein a second recess is formed in at least one of mutually facing surfaces of the lens component and the base; and the gasket is disposed in the second recess.

10. The LED lighting device according to claim 1, wherein a distance between a surface of a position of the lens component contacting with the gasket and a surface of a position of the base contacting with the gasket is less than an original size of the gasket when not pressurized in the direction perpendicular to the mounting surface of the base.

11. The LED lighting device according to claim 1, wherein sealant is disposed at the gasket between the base and the lens component.

12. The LED lighting device according to claim 11, wherein the sealant is disposed on the outer side of the gasket.

13. The LED lighting device according to claim 1, wherein the LED element includes at least one LED element; the lens component includes at least one lens; and the at least one LED element and the at least one lens are in one-to-one correspondence.

14. The LED lighting device according to claim 1, wherein at least one part of the lens component makes contact with the base in the area encircled by the gasket.

15. The LED lighting device according to claim 1, wherein the lens component is a transparent plate member provided with the lens.

16. The LED lighting device according to claim 1, wherein the second part is an integral annular structure.

17. The LED lighting device according to claim 1, wherein the second part includes a plurality of separate second subparts.

18. The LED lighting device according to claim 17, wherein the plurality of second subparts are uniformly distributed at the periphery of the lens component.

19. An assembly method of the LED lighting device according claim 1, comprising:

setting a surface of the first part of the fixing element facing the lens component to be upwards, and disposing the lens component on the fixing element;

disposing the gasket on the lens component; and disposing the base provided with the LED element on the lens component and the gasket in a state that a side provided with the LED element faces the lens component, and connecting the second part of the fixing element to the base.

20. The method according to claim 19, wherein in a mutually facing area of the first part of the fixing element and the lens component, a protrusion is formed on one of a surface of the first part of the fixing element facing the lens component and a surface of the lens component facing the first part of the fixing element, and a first recess is formed in the other one; and during disposing the lens component on the fixing element, the protrusion is embedded into the first recess.

21. The LED lighting device according to claim 1, wherein the second part of the fixing element is fixed to the base in an area outside of the area encircled by the gasket.

* * * * *